US008318399B2

(12) United States Patent
Hasegawa et al.

(10) Patent No.: US 8,318,399 B2
(45) Date of Patent: Nov. 27, 2012

(54) ELECTROSTATIC CHARGE IMAGE DEVELOPMENT CARRIER, ELECTROSTATIC CHARGE IMAGE DEVELOPER, PROCESS CARTRIDGE, IMAGE FORMING APPARATUS, AND IMAGE FORMING METHOD

(75) Inventors: Toshiaki Hasegawa, Kanagawa (JP); Takeshi Shoji, Kanagawa (JP); Sakon Takahashi, Kanagawa (JP); Fusako Kiyono, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 226 days.

(21) Appl. No.: 12/869,293

(22) Filed: Aug. 26, 2010

(65) Prior Publication Data

US 2011/0236820 A1 Sep. 29, 2011

(30) Foreign Application Priority Data

Mar. 23, 2010 (JP) ..... 2010-066812

(51) Int. Cl.
*G03G 9/08* (2006.01)

(52) U.S. Cl. ..... 430/111.35; 399/252

(58) Field of Classification Search ..... 430/111.35; 399/252
See application file for complete search history.

(56) References Cited

U.S. PATENT DOCUMENTS

2011/0253948 A1* 10/2011 Lussey et al. ..... 252/513

FOREIGN PATENT DOCUMENTS

| | | |
|---|---|---|
| JP | A-08-179570 | 7/1996 |
| JP | A-08-272148 | 10/1996 |
| JP | A-08-286429 | 11/1996 |
| JP | A-2007-248614 | 9/2007 |

* cited by examiner

*Primary Examiner* — Mark A Chapman
(74) *Attorney, Agent, or Firm* — Oliff & Berridge, PLC

(57) ABSTRACT

An electrostatic charge image development carrier includes magnetic core particles and a resin coating layer that contains titanium dioxide particles doped with niobium and coats each of the magnetic core particles.

17 Claims, 3 Drawing Sheets

ELECTROSTATIC CHARGE IMAGE DEVELOPMENT CARRIER, ELECTROSTATIC CHARGE IMAGE DEVELOPER, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2010-066812 filed Mar. 23, 2010.

BACKGROUND (i) Technical Field

The present invention relates to an electrostatic charge image development carrier, an electrostatic charge image developer, a process cartridge, an image forming apparatus, and an image forming method.

(ii) Related Art

Electrophotography that visualizes image information using an electrostatic charge image is currently utilized in various fields. In electrophotography, a method has been normally used in which an electrostatic charge image is formed on a latent image supporting body (photoconductor) or an electrostatic recording body using various units, and then developed/visualized by attaching charge-detecting particles called toner to the electrostatic charge image. A developer used herein is broadly classified as a two-component developer in which an appropriate amount of positive or negative charge is provided to toner by causing triboelectrification between particles called a carrier and toner particles, or a single-component developer that uses toner alone, such as magnetic toner. In particular, a two-component developer is widely used because the functions, such as stirring, conveying, and charging, required for a developer are separately provided to a carrier itself and thus the developer is easily designed.

In recent years, higher image quality, higher-speed processing, and long term stability of images formed with an image forming apparatus that uses electrophotography have been required. To satisfy such higher image quality, it has been increasingly considered that the size of toner particles be reduced and the charge amount of toner be made uniform and stabilized. With the reduction in toner particle size, it has also been considered that the size of carrier particles be reduced and the particle size distribution be narrowed. To achieve a uniform and stable charge amount, a core composition, a coating resin composition, and the like have been considered, which results in achieving even greater functionality.

A carrier needs to have a characteristic of charging toner in a desired charge amount as uniformly as possible. To achieve such a characteristic, a carrier and toner need to be uniformly mixed with each other and the surface characteristics of the carrier need to be more uniform. If the mixing is insufficient or the surface of the carrier is nonuniform, the charge amount easily becomes nonuniform. Furthermore, to adjust the charge amount of toner to a desired value or to stabilize the charge amount of toner used for a long time, the electrical resistance of the carrier needs to be adjusted. This is achieved by a publicly known method in which the surface of a carrier is coated with a resin, and conductive powder such as carbon black is dispersed in the resin layer to adjust the electrical resistance.

SUMMARY

According to an aspect of the invention, there is provided an electrostatic charge image development carrier including magnetic core particles and a resin coating layer that contains titanium dioxide particles doped with niobium and coats each of the magnetic core particles.

BRIEF DESCRIPTION OF THE DRAWINGS

Exemplary embodiments of the present invention will be described in detail based on the following figures, wherein.

DETAILED DESCRIPTION

Figure 1:
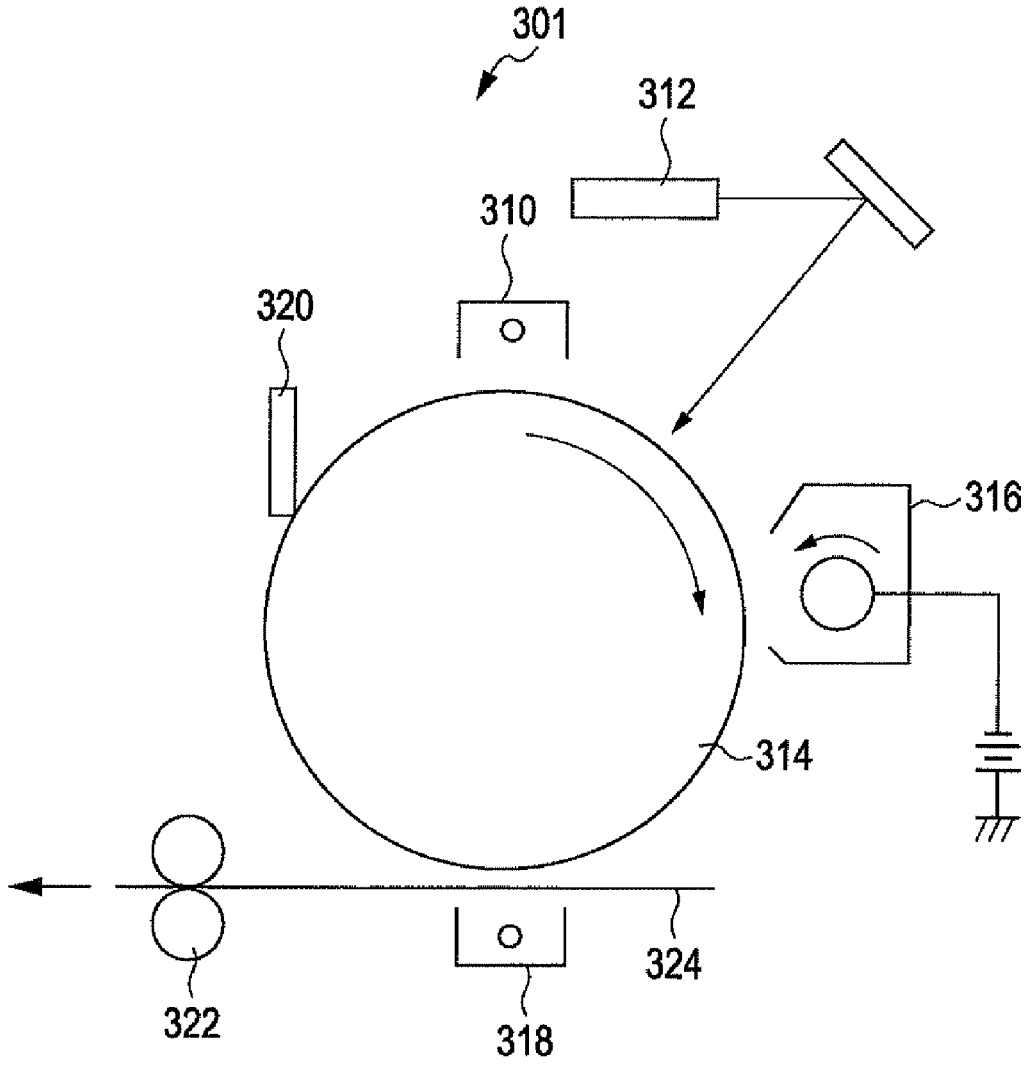
FIG. 1 schematically shows an image forming apparatus according to a first exemplary embodiment.

An electrostatic charge image development carrier, an electrostatic charge image developer, a process cartridge, an image forming apparatus, and an image forming method according to an exemplary embodiment of the present invention will now be described in detail.

Electrostatic Charge Image Development Carrier

An electrostatic charge image development carrier (hereinafter may be simply referred to as "carrier") according to this exemplary embodiment includes magnetic core particles and a resin coating layer that contains titanium dioxide particles doped with niobium (hereinafter may be referred to as "specific titanium dioxide particles") and coats each of the magnetic core particles.

With the colorization of images formed by electrophotography, when a developer including a carrier whose resin coating layer contains carbon black is used, the resin coating layer is shaved off due to the long-term usage of a developer and the resin containing carbon black is sometimes mixed in toner and developed. This may cause color smear of printed images or degrade color reproducibility.

Therefore, white or transparent conductive powder or conductive powder having weak tinting power is considered to be used, but these conductive powders have higher powder resistance than carbon black. To adjust the carrier resistance to a desired value and achieve the same effects as those of carbon black, a large amount of such conductive powder needs to be added. Thus, the strength of the resin coating layer is not maintained, and the detachment or shaving-off of the resin coating layer may be caused due to the long-term usage of a developer.

When conductive powder having a specific gravity higher than that of carbon black is used, a larger amount of conductive powder than when using carbon black needs to be added to ensure a conductive route which is equal to that of carbon black in the resin coating layer. Furthermore, the difference in specific gravity between a coating resin and conductive powder is large. Consequently, when conductive powder is dispersed in a solvent or a coating resin in a resin coating step performed when a carrier is produced, the precipitation or aggregation of the conductive powder is easily caused, which produces a lump of conductive powder in the resin coating layer. If such a developer is used for a long time, the development voltage or the like is leaked through the lump of the conductive powder at high temperature and high humidity, and thus image defects (also called "white spots"), which are missing dots in an image, may be caused.

As a result of the extensive studies, the inventors of the present invention found that, in an electrostatic charge image development carrier including magnetic core particles and a resin coating layer that coats each of the magnetic core particles, the electrical resistance of the carrier is controlled to a desired value, a stable toner charge amount is achieved for a long time, and a carrier having a small number of image defects such as white spots caused by charge leakage due to the lump of conductive powder when used for a long time is obtained by incorporating titanium dioxide particles doped with niobium in the resin coating layer as conductive powder.

The carrier according to this exemplary embodiment includes magnetic core particles and a resin coating layer that contains specific titanium dioxide particles as a conductive material and coats each of the magnetic core particles. A configuration of the carrier according to this exemplary embodiment will now be described.

In this exemplary embodiment, the magnetic core particles are normally resin particles having a magnetic metal, a magnetic oxide, or magnetic particles dispersed therein. However, such a material poses problems in that the chargeability varies considerably in accordance with environment because such a material has a hydrophilicity and thus the chargeability is decreased at high humidity and in that the chargeability is not satisfactorily maintained because such a material has high surface energy and thus is easily contaminated by toner components. Therefore, the problems regarding chargeability are addressed by coating the surface of a carrier with a resin having hydrophobicity or low surface energy. However, if the surface of the core is coated with an insulating resin at a high coverage, the electrical resistance displayed as a carrier is increased, which may degrade the reproducibility of solid images. In order to prevent the increase in electrical resistance, a charge controlling agent or a conductive material needs to be dispersed in the resin coating layer.

Typical examples of a method for coating the surfaces of magnetic core particles with a resin coating layer include a dipping method in which a resin, a conductive material, and the like are added to a solvent that dissolves a resin to obtain a coating layer formation solution, and magnetic core particles are dipped in the coating layer formation solution; a spraying method in which the coating layer formation solution is sprayed on the surfaces of the magnetic core particles; a fluidized-bed method in which the coating layer formation solution is sprayed while the magnetic core particles are made to float with flowing air; and a kneader coater method in which the magnetic core particles are mixed with the coating layer formation solution in a kneader coater and then a solvent is removed. In this exemplary embodiment, a kneader coater method is suitable for the production.

The magnetic core particles used in this exemplary embodiment are not particularly limited, and are, for example, resin particles having a magnetic metal such as iron, steel, nickel, or cobalt; a magnetic oxide such as ferrite or magnetite; or magnetic particles dispersed therein. In this exemplary embodiment, a magnetic material needs to be used, and the magnetic material is obtained by using magnetic powder itself as a core or by pulverizing magnetic powder and dispersing the pulverized powder in a resin.

The volume-average particle size of the magnetic core particles is 15 μm or more and 100 μm or less or about 15 μm or more and 100 μm or less.

Examples of the coating resin used in this exemplary embodiment include polyethylene, polypropylene, polystyrene, polyacrylonitrile, polyvinyl acetate, polyvinyl alcohol, polyvinyl butyral, polyvinyl chloride, polyvinyl carbazole, polyvinyl ether, polyvinyl ketone, polyacrylate, vinyl chloride-vinyl acetate copolymers, styrene-acrylic acid copolymers, straight silicone resins including organosiloxane bonds and modified products thereof, fluorocarbon resins, polyester, polyurethane, polycarbonate, phenol resins, amino resins, melamine resins, benzoguanamine resins, urea resins, amide resins, and epoxy resins. The coating resin is not limited thereto, and polystyrene, polyacrylate, or a styrene-acrylic acid copolymer is particularly suitable.

The resin coating layer according to this exemplary embodiment may contain a wax. Wax has hydrophobicity, and is relatively soft at room temperature and has low film strength. These are derived from the molecular structure of wax, and because of the presence of wax having such characteristics in the resin coating layer, fine particles that are an external additive added to the surface of toner or toner components such as a toner bulk component are not easily attached to the surface of a carrier. Even if such attachment is caused, wax molecules come off in the portion where the attachment has been caused and the surface of a carrier is renewed, which produces an effect in which the surface of a carrier is not easily contaminated through attachment.

The wax is not particularly limited. Examples of the wax include paraffin wax and the derivatives thereof, montan wax and the derivatives thereof, microcrystalline wax and the derivatives thereof, Fischer-Tropsch wax and the derivatives thereof, and polyolefin wax and the derivatives thereof. The derivatives include oxides, polymers obtained with vinyl monomers, and graft-modified waxes. Alternatively, an alcohol, a fatty acid, a vegetable wax, an animal wax, a mineral wax, an ester wax, an acid amide, or a publicly known wax may be used. The melting temperature of the wax is preferably 60° C. or more and 200° C. or less and more preferably 80° C. or more and 150° C. or less or about 80° C. or more and 150° C. or less. If the melting temperature is less than 60° C., the flowability of a carrier may be degraded.

The glass transition temperature of wax is measured in accordance with JIS 7121-1987 using a differential scanning calorimeter.

Any publicly known charge controlling agent may be contained in the resin coating layer according to this exemplary embodiment. Examples of the charge controlling agent include nigrosine dyes, benzimidazole compounds, quaternary ammonium salt compounds, alkoxylated amines, alkylamides, molybdic acid chelate pigments, triphenylmethane compounds, salicylic acid metal complexes, azo chromium complexes, and copper phthalocyanine. Quaternary ammonium salt compounds, alkoxylated amines, and alkylamides are particularly suitable.

In this exemplary embodiment, in order to suppress color smear and the degradation of color reproducibility as much as possible, a white or transparent charge controlling agent or a charge controlling agent having weak tinting power needs to be selected. Alternatively, if a charge controlling agent having strong tinting power is used, the amount of the charge controlling agent added needs to be reduced. The dispersion state is easily controlled by such a controlling agent. Furthermore, since the charge controlling agent suitably adheres to the surface of the coating resin, the detachment of the charge controlling agent from the resin coating layer is suppressed. The charge controlling agent also functions as a dispersion aid for a conductive material. As a result, the dispersion state of specific titanium dioxide particles in the resin coating layer is made uniform, and the change in carrier resistance is suppressed even if the resin coating layer is detached to some extent.

The content of the charge controlling agent used in this exemplary embodiment is preferably 0.001 parts by mass or more and 5 parts by mass or less relative to 100 parts by mass of the magnetic core particles and more preferably 0.01 parts by mass or more and 0.5 parts by mass or less. If the content of the charge controlling agent is more than 5 parts by mass, the strength of the resin coating layer may be decreased and the carrier may be easily subjected to change in quality due to the stress in use. If the content of the charge controlling agent is less than 0.001 parts by mass, the functions of the charge controlling agent are not sufficiently delivered and the dispersiveness of a conductive material is sometimes not improved.

Nitrogen-containing resin particles may be used to suppress a decrease in charge amount. In particular, a urea resin, an urethane resin, a melamine resin, a guanamine resin, and an amide resin are suitable because they display high positive chargeability and a decrease in charge amount caused by the detachment of the resin coating layer is suppressed due to high hardness of the resins.

The content of the nitrogen-containing resin particles used in this exemplary embodiment is preferably 0.01 parts by mass or more and 5 parts by mass or less or about 0.01 parts by mass or more and 5 parts by mass or less relative to 100 parts by mass of the magnetic core particles and more preferably 0.1 parts by mass or more and 0.5 parts by mass or less. If the content of the nitrogen-containing resin particles is more than 5 parts by mass, the strength of the resin coating layer may be decreased and the carrier may be easily subjected to change in quality due to the stress in use. If the content of the nitrogen-containing resin particles is less than 0.01 parts by mass, a decrease in charge amount is sometimes not sufficiently suppressed.

In this exemplary embodiment, the specific titanium dioxide particles need to be used as a conductive material, but a typical conductive material may be used together. Examples of the conductive material include metals such as gold, silver, and copper, titanium oxide, zinc oxide, tin oxide, barium sulfate, aluminum borate, potassium titanate, tin oxide doped with antimony, indium oxide doped with tin, zinc oxide doped with aluminum, resin particles coated with a metal, and carbon black. In this exemplary embodiment, in order to suppress color smear and the degradation of color reproducibility as much as possible, a white or transparent conductive material or a conductive material having weak tinting power needs to be selected. Alternatively, if a conductive material having strong tinting power such as carbon black is used, the amount of the conductive material added needs to be reduced as much as possible.

In this exemplary embodiment, "doping with niobium" means that titanium atoms in a titanium dioxide crystal are partly replaced with niobium atoms, and part of the niobium atoms added needs only to be substituted. Compared with titanium dioxide alone, electrical resistance is decreased by doping titanium dioxide with niobium, tantalum, tungsten, or the like. In particular, niobium is suitable in terms of the decreasing rate of electrical resistance.

The titanium dioxide particles are doped with niobium so that the molar ratio of niobium to titanium contained in the specific titanium dioxide particles is preferably 1:200 to 1:5 or about 1:200 to 1:5 and more preferably 1:100 to 1:10. If the amount of niobium is smaller than that expressed by a molar ratio of 1:200, there is no obvious effect of decreasing electrical resistance compared with titanium dioxide by itself. Even if the amount of niobium is larger than that expressed by a molar ratio of 1:5, there is no more effect of decreasing electrical resistance. If the amount of niobium is larger than that expressed by a molar ratio of 1:5, the production is sometimes made difficult.

The amount of niobium with which the specific titanium dioxide particles are doped (the molar ratio of niobium to titanium contained in the specific titanium dioxide particles) is measured by the method described below.

The specific titanium dioxide particles containing niobium are dissolved in a mixed solution of sulfuric acid and hydrofluoric acid, and then analyzed with a plasma emission spectrophotometer to measure the molar ratio. A mixture of niobium oxide and titanium oxide in which the molar ratio of niobium to titanium is known is separately prepared for making a calibration curve. The intensities of titanium oxide and niobium oxide are measured with an X-ray diffractometer using a CuKα X-ray to prepare a calibration curve. Similarly, the intensity of niobium oxide contained in the titanium dioxide particles dissolved in the mixed solution is measured. The amount of niobium with which the specific titanium dioxide particles are doped is obtained by measuring the decreased amount of niobium oxide from the prepared calibration curve.

A method for extracting the specific titanium dioxide particles from the carrier according to this exemplary embodiment is as follows.

A carrier weighed in a beaker is mixed with an organic solvent (e.g., chloroform) that dissolves a coating resin, and the mixture is sonicated with an ultrasonic dispersion machine. By putting a magnet on the bottom of the beaker, an organic solvent containing the coating resin and the titanium dioxide particles is collected. By performing this process three times, the core particles are completely removed. The collected organic solvent is centrifuged and the resultant precipitate is dried. Thus, the titanium dioxide particles are extracted.

In this exemplary embodiment, the volume-average particle size of the specific titanium dioxide particles is preferably 5 nm or more and 1000 nm or less or about 5 nm or more and 1000 nm or less and more preferably 15 nm or more and 200 nm or less. If the volume-average particle size of the specific titanium dioxide particles is less than 5 nm, the specific titanium dioxide particles are not easily dispersed in the resin coating layer and thus the strength of the resin coating layer may be decreased. If the volume-average particle size of the specific titanium dioxide particles is more than 1000 nm, the specific titanium dioxide particles are easily exposed from the resin coating layer. Consequently, the electrical resistance tends to be decreased and white spots may be easily generated.

In this exemplary embodiment, the volume-average particle size of the specific titanium dioxide particles is a value obtained by the method described below.

A surfactant is added to the extracted specific titanium dioxide particles. After the mixture is dispersed with an ultrasonic dispersion machine, the volume-average particle size is measured with Submicron Particle Size Analyzer Delsa Nano S (available from Beckman Coulter, Inc.).

In this exemplary embodiment, a method for producing the specific titanium dioxide particles is not particularly limited as long as the method is a typical method for producing composite metal oxide particles. Examples of the method include solid phase methods such as crushing; gas phase methods such as a flame method, a plasma method, a vacuum deposition method, and a sputtering method; and liquid phase methods such as a coprecipitation method, a homogeneous precipitation method, a metal alkoxide method, and a spray-drying method. Among these methods, a dry gas phase method is suitable because of the controllability of particle size and a small amount of impurities mixed.

In this exemplary embodiment, in order to adjust the resistance value of the specific titanium dioxide particles to a desired value, a titanium dioxide bulk that is doped with niobium and has not yet been pulverized or titanium dioxide that is doped with niobium and has been pulverized may be subjected to heat treatment in a reducing atmosphere or may be subjected to alkali treatment and then heat treatment.

It is known that titanium dioxide has anatase and rutile crystal forms. Most of the specific titanium dioxide particles according to this exemplary embodiment have an anatase or rutile crystal form. As the number of the specific titanium dioxide particles having an anatase crystal form is increased, the resistance value is decreased. Therefore, the specific titanium dioxide particles suitably contain 70% or more or about 70% or more anatase crystals.

The ratio of titanium dioxide particles having an anatase crystal form to titanium dioxide particles having a rutile crystal form is obtained from the intensity ratio of an anatase (101) diffraction line to a rutile (110) diffraction line with an X-ray diffractometer using a CuKα X-ray.

In this exemplary embodiment, the electrical resistance of the specific titanium dioxide particles is preferably $10^{-5}$ Ω·cm or more and $10^{6}$ Ω·cm or less or about $10^{-5}$ Ω·cm or more and $10^{6}$ Ω·cm or less and more preferably $10^{-3}$ Ω·cm or more and $10^{3}$ Ω·cm or less. It is currently difficult to produce specific titanium dioxide particles having an electrical resistance of less than $10^{-5}$ Ω·cm. Specific titanium dioxide particles having an electrical resistance of more than $10^{6}$ Ω·cm sometimes need to be added in a large amount in order that the carrier according to this exemplary embodiment has a desired electrical resistance.

A solvent used for preparing the coating layer formation solution is not particularly limited as long as the solvent dissolves the coating resin. Examples of the solvent include aromatic hydrocarbons such as toluene and xylene, ketones such as acetone and methyl ethyl ketone, ethers such as tetrahydrofuran and dioxane, and halides such as chloroform and carbon tetrachloride.

The average thickness of the resin coating layer is normally 0.1 μm or more and 10 μm or less or about 0.1 μm or more and 10 μm or less, but is preferably 0.5 μm or more and 3 μm or less to achieve stable volume resistivity of the carrier over time.

The amount of the specific titanium dioxide particles is preferably 3% or more and 20% or less by mass relative to the amount of resin components constituting the resin coating layer, and more preferably 5% or more and 10% or less by mass.

To achieve high image quality, the volume resistivity value of the carrier according to this exemplary embodiment is preferably $10^{6}$ Ω·cm or more and $10^{14}$ Ω·cm or less or about $10^{6}$ Ω·cm or more and $10^{14}$ Ω·cm or less and more preferably $10^{8}$ Ω·cm or more and $10^{13}$ Ω·cm or less at 1000 V, which corresponds to the upper and lower limits of a typical development contrast potential.

If the volume resistivity value of the carrier is less than $10^{6}$ Ω·cm, the amount of a charge that moves from the carrier to a photoconductor (latent image supporting body) is increased, and thus white spots may be easily formed. On the other hand, if the volume resistivity value of the carrier is more than $10^{14}$ Ω·cm, a black solid image may be formed or color smear in a halftone image may be caused.

The volume-average particle size of the carrier according to this exemplary embodiment is 15 μm or more and 100 μm or less.

Electrostatic Charge Image Developer

The electrostatic charge image developer (hereinafter may be simply referred to as "developer") according to this exemplary embodiment includes the carrier according to this exemplary embodiment and toner. The developer according to this exemplary embodiment is prepared by mixing the carrier according to this exemplary embodiment and toner in a certain ratio. The content of the carrier ((carrier)/(carrier+toner)×100) is preferably 85% or more and 99% or less by mass, more preferably 87% or more and 98% or less by mass, and more preferably 89% or more and 97% or less by mass.

The toner used for the electrostatic charge image developer according to this exemplary embodiment will now be described.

The toner used in this exemplary embodiment contains at least a binding resin and a coloring agent and optionally contains a release agent and other components. The toner used in this exemplary embodiment suitably contains external additives used for various purposes, in addition to the so-called toner particles having the above described components.

A publicly known binding resin, various coloring agents, and the like may be used for the toner used in this exemplary embodiment. A polyester resin, a polyolefin resin, a styrene-acrylic acid copolymer, a styrene-methacrylic acid copolymer, polyvinyl chloride, a phenol resin, an acrylic resin, a methacrylic resin, polyvinyl acetate, a silicone resin, a modified polyester resin, polyurethane, a polyamide resin, a furan resin, an epoxy resin, a xylene resin, polyvinyl butyral, a terpene resin, a coumarone-indene resin, a petroleum resin, and a polyether polyol resin may be used alone or in combination as the binding resin of the toner used in this exemplary embodiment.

Examples of a cyan coloring agent of the toner used in this exemplary embodiment include cyan pigments such as C.I. Pigment Blue 1, C.I. Pigment Blue 2, C.I. Pigment Blue 3, C.I. Pigment Blue 4, C.I. Pigment Blue 5, C.I. Pigment Blue 6, C.I. Pigment Blue 7, C.I. Pigment Blue 10, C.I. Pigment Blue 11, C.I. Pigment Blue 12, C.I. Pigment Blue 13, C.I. Pigment Blue 14, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 15:6, C.I. Pigment Blue 16, C.I. Pigment Blue 17, C.I. Pigment Blue 23, C.I. Pigment Blue 60, C.I. Pigment Blue 65, C.I. Pigment Blue 73, C.I. Pigment Blue 83, C.I. Pigment Blue 180, C.I. Vat Cyan 1, C.I. Vat Cyan 3, C.I. Vat Cyan 20, Prussian blue, cobalt blue, alkali blue lake, phthalocyanine blue, metal-free phthalocyanine blue, partially chlorinated phthalocyanine blue, Fast Sky Blue, Indanthrene Blue BC; and cyan dyes such as C.I. Solvent Cyan 79 and C.I. Solvent Cyan 162.

Examples of a magenta coloring agent include magenta pigments such as C.I. Pigment Red 1, C.I. Pigment Red 2, C.I. Pigment Red 3, C.I. Pigment Red 4, C.I. Pigment Red 5, C.I. Pigment Red 6, C.I. Pigment Red 7, C.I. Pigment Red 8, C.I. Pigment Red 9, C.I. Pigment Red 10, C.I. Pigment Red 11, C.I. Pigment Red 12, C.I. Pigment Red 13, C.I. Pigment Red 14, C.I. Pigment Red 15, C.I. Pigment Red 16, C.I. Pigment Red 17, C.I. Pigment Red 18, C.I. Pigment Red 19, C.I. Pigment Red 21, C.I. Pigment Red 22, C.I. Pigment Red 23, C.I. Pigment Red 30, C.I. Pigment Red 31, C.I. Pigment Red 32, C.I. Pigment Red 37, C.I. Pigment Red 38, C.I. Pigment Red 39, C.I. Pigment Red 40, C.I. Pigment Red 41, C.I. Pigment Red 48, C.I. Pigment Red 49, C.I. Pigment Red 50, C.I. Pigment Red 51, C.I. Pigment Red 52, C.I. Pigment Red 53, C.I. Pigment Red 54, C.I. Pigment Red 55, C.I. Pigment Red 57, C.I. Pigment Red 58, C.I. Pigment Red 60, C.I. Pigment Red 63, C.I. Pigment Red 64, C.I. Pigment Red 68, C.I. Pigment Red 81, C.I. Pigment Red 83, C.I. Pigment Red 87, C.I. Pigment Red 88, C.I. Pigment Red 89, C.I. Pigment Red 90, C.I. Pigment Red 112, C.I. Pigment Red 114, C.I. Pigment Red 122, C.I. Pigment Red 123, C.I. Pigment Red 163, C.I. Pigment Red 184, C.I. Pigment Red 202, C.I. Pigment Red 206, C.I. Pigment Red 207, C.I. Pigment Red 209, and Pigment Violet 19; magenta dyes such as C.I. Solvent Red 1, C.I. Solvent Red 3, C.I. Solvent Red 8, C.I. Solvent Red 23, C.I. Solvent Red 24, C.I. Solvent Red 25, C.I. Solvent Red 27, C.I. Solvent Red 30, C.I. Solvent Red 49, C.I. Solvent Red 81, C.I. Solvent Red 82, C.I. Solvent Red 83, C.I. Solvent Red 84, C.I. Solvent Red 100, C.I. Solvent Red 109, C.I. Solvent Red 121, C.I. Disperse Red 9, C.I. Basic Red 1, C.I. Basic Red 2, C.I. Basic Red 9, C.I. Basic Red 12, C.I. Basic Red 13, C.I. Basic Red 14, C.I. Basic Red 15, C.I. Basic Red 17, C.I. Basic Red 18, C.I. Basic Red 22, C.I. Basic Red 23, C.I. Basic Red 24, C.I. Basic Red 27, C.I. Basic Red 29, C.I. Basic Red 32, C.I. Basic Red 34, C.I. Basic Red 35, C.I. Basic Red 36, C.I. Basic Red 37, C.I. Basic Red 38, C.I. Basic Red 39, and C.I. Basic Red 40; iron red; cadmium red; minimum; mercury sulfide; cadmium; Permanent Red 4R; Lithol Red; Pyrazolone Red; Watching Red; calcium salts; Lake Red D; Brilliant Carmine 6B; Eosin Lake; Rhodamine Lake B; alizarin lake; and Brilliant Carmine 3B.

Examples of a yellow coloring agent include yellow pigments such as C.I. Pigment Yellow 2, C.I. Pigment Yellow 3, C.I. Pigment Yellow 15, C.I. Pigment Yellow 16, C.I. Pigment Yellow 17, C.I. Pigment Yellow 97, C.I. Pigment Yellow 180, C.I. Pigment Yellow 185, and C.I. Pigment Yellow 139.

In the case of black toner, for example, carbon black, activated carbon, titanium black, magnetic powder, or non-magnetic powder containing Mn may be used as the coloring agent.

The toner used in this exemplary embodiment suitably contains a charge controlling agent. Examples of the charge controlling agent include nigrosine, quaternary ammonium salts, organic metal complexes, and chelate complexes.

Furthermore, silica, titanium oxide, barium titanate, fluorocarbon particles, and acrylic particles may be used in combination as the external additives. Commercially available TG820 (produced by Cabot Corporation) or HVK2150 (produced by Clariant) may be used as silica.

The toner used in this exemplary embodiment suitably further contains a release agent. Examples of the release agent include unsaturated fatty acids such as ester wax, polyethylene, polypropylene, polyethylene-polypropylene copolymers, polyglycerin wax, microcrystalline wax, paraffin wax, carnauba wax, sasol wax, montanic acid ester wax, deoxidized carnauba wax, palmitic acid, stearic acid, montanic acid, brassidic acid, eleostearic acid, and parinaric acid; saturated alcohols such as stearyl alcohol, aralkyl alcohol, behenyl alcohol, carnaubyl alcohol, ceryl alcohol, melissyl alcohol, and long-chain alkyl alcohols having longer-chain alkyl groups; polyhydric alcohols such as sorbitol; fatty acid amides such as linoleic acid amide, oleic acid amide, and lauric acid amide; saturated fatty acid bis-amides such as methylene-bis-stearic acid amide, ethylene-bis-capric acid amide, ethylene-bis-lauric acid amide, and hexamethylene-bis-stearic acid amide; unsaturated fatty acid amides such as ethylene-bis-oleic acid amide, hexamethylene-bis-oleic acid amide, N,N'-dioleyladipic acid amide, and N,N'-dioleylsebacic acid amide; aromatic bis-amides such as m-xylene-bis-stearic acid amide and N,N'-distearylisophthalic acid amide; fatty acid metal salts (generally called metallic soap) such as calcium stearate, calcium laurate, zinc stearate, and magnesium stearate; grafted waxes obtained by grafting aliphatic hydrocarbon waxes with vinyl monomers such as styrene and acrylic acid; partially esterified compounds between a fatty acid and a polyhydric alcohol such as behenic acid monoglyceride; and methyl ester compounds having a hydroxyl group and obtained by hydrogenating vegetable fat and oil.

In this exemplary embodiment, a method for producing toner (toner particles) is not particularly limited, but a wet method is desired to achieve high image quality. Examples of the wet method include an emulsion aggregation method in which emulsion polymerization is performed on polymerizable monomers of a binding resin, and the resultant binding resin-dispersed liquid, a coloring agent, a release agent, and optionally a dispersion liquid of a charge control agent are mixed to cause aggregation and heat fusion; a suspension polymerization method in which polymerizable monomers for obtaining a binding resin, a coloring agent, a release agent, and optionally a solution of a charge control agent are suspended in an aqueous solvent and then polymerization is performed; and a dissolving and suspending method in which a binding resin, a coloring agent, a release agent, and optionally a solution of a charge control agent are suspended in an aqueous solvent to perform granulation. Alternatively, the toner particles obtained by the above-described method may be used as cores, resin particles are made to adhere to the toner particles, and heating and fusion are performed to provide a core-shell structure. The toner particles may be obtained by a typical crushing and classifying method.

Image Forming Apparatus, Image Forming Method, and Process Cartridge

An image forming apparatus according to this exemplary embodiment includes a latent image supporting body, a charging unit that charges a surface of the latent image supporting body, an electrostatic charge image forming unit that forms an electrostatic charge image on the surface of the latent image supporting body, a developing unit that develops the electrostatic charge image with the electrostatic charge image developer according to this exemplary embodiment to form a toner image, a transferring unit that transfers the toner image onto a recording medium, and a fixing unit that fixes the toner image on the recording medium. The image forming apparatus according to this exemplary embodiment may optionally include a latent image supporting body cleaning unit that cleans the surface of the latent image supporting body.

In this image forming apparatus, for example, a device including the developing unit may be a process cartridge (have a cartridge structure) that is detachably installed in the main body of the image forming apparatus. A process cartridge according to this exemplary embodiment is suitably used as the above described process cartridge. The process cartridge according to this exemplary embodiment includes a developing unit that develops an electrostatic charge image formed on a surface of a latent image supporting body with the electrostatic charge image developer according to this exemplary embodiment to form a toner image, wherein the process cartridge is detachably installed in an image forming apparatus and accommodates the electrostatic charge image developer.

An image forming method according to this exemplary embodiment includes charging a surface of a latent image supporting body, forming an electrostatic charge image on the surface of the latent image supporting body, developing the electrostatic charge image with the electrostatic charge image developer according to this exemplary embodiment to form a toner image, transferring the toner image onto a recording medium, and fixing the toner image on the recording medium.

An example of the image forming apparatus according to this exemplary embodiment will now be described below, but is not limited thereto.

FIG. 1 schematically shows an image forming apparatus according to a first exemplary embodiment. An image forming apparatus 301 includes a charging device 310, an exposure device 312, an electrophotographic photoconductor 314 that is a latent image supporting body, a developing device 316, a transferring device 318, a cleaning device 320, and a fixing device 322.

In the image forming apparatus 301, the charging device 310, the exposure device 312, the developing device 316, the transferring device 318, and the cleaning device 320 are disposed near/on the circumference of the electrophotographic photoconductor 314 in that order. The charging device 310 is a charging unit that charges the surface of the electrophotographic photoconductor 314. The exposure device 312 is an electrostatic charge image forming unit that exposes the charged electrophotographic photoconductor 314 to form an electrostatic charge image in accordance with image information. The developing device 316 is a developing unit that develops the electrostatic charge image with a developer to form a toner image. The transferring device 318 is a transferring unit that transfers the toner image formed on the surface of the electrophotographic photoconductor 314 onto the surface of a recording medium 324. The cleaning device 320 is a latent image supporting body cleaning unit that cleans the surface of the electrophotographic photoconductor 314 by removing foreign matter such as toner left on the surface of the electrophotographic photoconductor 314 after the toner image has been transferred. The fixing device 322, which is a fixing unit that fixes the toner image transferred onto the recording medium 324, is disposed beside the transferring device 318.

An operation of the image forming apparatus 301 according to this exemplary embodiment will now be described. First, the surface of the electrophotographic photoconductor 314 is charged by the charging device 310. The surface of the electrophotographic photoconductor 314 is then irradiated with light by the exposure device 312, and the charge in the portion irradiated with light is removed. Consequently, an electrostatic charge image is formed in accordance with image information. Subsequently, the electrostatic charge image is developed by the developing device 316, and thus a toner image is formed on the surface of the electrophotographic photoconductor 314. For example, in the case of a digital electrophotographic copier in which an organic photoconductor is used as the electrophotographic photoconductor 314 and a laser beam light source is used as the exposure device 312, a negative charge is provided to the surface of the electrophotographic photoconductor 314 by the charging device 310; a digital latent image is formed in a dot pattern with laser beam light; and toner is supplied, by the developing device 316, to the portion irradiated with the laser beam light to achieve visualization. In this case, a negative bias is applied to the developing device 316. Next, a recording medium 324 such as paper is placed on the toner image at the transferring device 318. A charge whose polarity is opposite to that of the toner is provided to the recording medium 324 from the back of the recording medium 324. Thus, the toner image is transferred onto the recording medium 324 by electrostatic force. Heat and pressure are applied to the transferred toner image by a fixing member at the fixing device 322, and the toner image is fused and fixed on the recording medium 324. Foreign matter such as toner left on the surface of the electrophotographic photoconductor 314 without being transferred is removed by the cleaning device 320. One cycle is completed through the processes from the charging to the cleaning. In FIG. 1, the toner image is directly transferred onto the recording medium 324 such as paper at the transferring device 318, but is transferred through a transfer body such as an intermediate transfer body.

The charging unit, the latent image supporting body, the electrostatic charge image forming unit (exposure unit), the developing unit, the transferring unit, the latent image supporting body cleaning unit, and the fixing unit in the image forming apparatus 301 of FIG. 1 will now be described.

Charging Unit

For example, a corotron charger shown in FIG. 1 is used as the charging device 310 (charging unit), and a conductive or semiconductive charging roller may also be used. For a contact-type charger that uses the conductive or semiconductive charging roller, a direct current or a current obtained by superimposing an alternating current on a direct current may be applied to the electrophotographic photoconductor 314. For example, the surface of the electrophotographic photoconductor 314 is charged by generating discharge using the charging device 310 in a minute space near the contact area between the charging device 310 and the electrophotographic photoconductor 314. The surface of the electrophotographic photoconductor 314 is normally charged at between −300 V and −1000 V. The conductive or semiconductive charging roller may have a single-layer structure or a multi-layer structure. A mechanism may be provided that cleans the surface of the charging roller.

Latent Image Supporting Body

The latent image supporting body has a function of forming at least a latent image (electrostatic charge image). An electrophotographic photoconductor is suitably used as the latent image supporting body. The electrophotographic photoconductor 314 includes a cylindrical conductive base and a film that contains an organic photoconductor or the like and is formed on the outer peripheral surface of the base. The film is obtained by forming an undercoating layer (if necessary), a charge generating layer composed of a charge generating material, and a charge transporting layer composed of a charge transporting material on the base in that order. Herein, the charge generating layer and the charge transporting layer constitute a photosensitive layer. The order of stacking the charge generating layer and the charge transporting layer may be opposite. In this case, the charge generating material and the charge transporting material are separately contained in different layers (charge generating layer and charge transporting layer), and the layers are stacked to form a stacked photoconductor. However, a single-layer photoconductor containing both the charge generating material and the charge transporting material in the same layer may be used. The stacked photoconductor is more desirable. An intermediate layer may be formed between the undercoating layer and the photosensitive layer. Instead of the organic photoconductor, a different type of photosensitive layer such as an amorphous silicon photosensitive film may be used.

Electrostatic Charge Image Forming Unit

The exposure device 312 that is an electrostatic charge image forming unit (exposure unit) is not particularly limited. For example, an optical instrument that exposes the surface of the latent image supporting body to light of a semiconductor laser, a light-emitting diode (LED), a liquid crystal shutter, or the like so as to form a desired image pattern is exemplified as the exposure device 312.

Developing Unit

The developing device 316 that is a developing unit has a function of developing a latent image formed on the latent image supporting body with a developer containing toner to form a toner image. Such a developing device is not particularly limited as long as the device has the above-described function, and thus the device is selected in accordance with the purpose. A publicly known developing device having a function of attaching electrostatic charge image development toner to the electrophotographic photoconductor 314 using a brush, a roller, or the like is exemplified. A direct-current voltage is normally applied to the electrophotographic photoconductor 314, but a voltage obtained by superimposing an alternating-current voltage on a direct-current voltage may be applied to the electrophotographic photoconductor 314.

Transferring Unit

A device that provides a charge whose polarity is opposite to that of the toner to the recording medium 324 shown in FIG. 1 from the back of the recording medium 324 and transfers a toner image onto the recording medium 324 by electrostatic force is used as the transferring device 318 that is a transferring unit. Alternatively, a transferring roller that uses a conductive or semiconductive roller configured to perform transferring while being directly in contact with the recording medium 324 and a transferring roller pressing apparatus may be used. A direct current or a current obtained by superimposing an alternating current on a direct current may be applied to the transferring roller as a transfer current provided to the latent image supporting body. The transferring roller may be appropriately selected in accordance with the width of an image area to be charged, the shape of a transferring charger, the width of an opening, processing speed (peripheral speed), and the like. To reduce cost, a single-layer foamed roller or the like is suitably used as the transferring roller. Transferring may be performed directly on the recording medium 324 such as paper or may be performed on the recording medium 324 through an intermediate transfer body.

A publicly known intermediate transfer body may be used. Examples of a material of the intermediate transfer body include polycarbonate (PC) resins, polyvinylidene fluoride (PVDF), polyalkylene phthalate, a mixed material of PC/polyalkylene terephthalate (PAT), a mixed material of ethylene tetrafluoroethylene (ETFE) copolymer/PC, a mixed material of ETFE/PAT, and a mixed material PC/PAT. In terms of mechanical strength, an intermediate transfer belt composed of a thermosetting polyimide resin is desirably used.

Latent Image Supporting Body Cleaning Unit

For the cleaning device 320 that is a latent image supporting body cleaning unit, any device that adopts blade cleaning, brush cleaning, or roller cleaning may be selected as long as the device has a function of cleaning foreign matter such as residual toner left on the latent image supporting body.

Fixing Unit

The fixing device 322 that is a fixing unit (image fixing device) has a function of fixing a toner image transferred onto the recording medium 324 by applying heat, pressure, or heat and pressure, and includes a fixing member.

Recording Medium

Examples of the recording medium 324 onto which the toner image is transferred include plain paper and overhead projector (OHP) sheets used in an electrophotographic copier, a printer, or the like. To further improve the smoothness of the surface of a fixed image, the surface of the recording medium is also suitably made smooth. For example, coated paper obtained by coating the surface of plain paper with a resin or the like or art paper for printing may be used.

By the combination with the trickle development proposed in Japanese Examined Patent Application Publication No. 2-21591, an image having long-term stability is formed.

Figure 2:
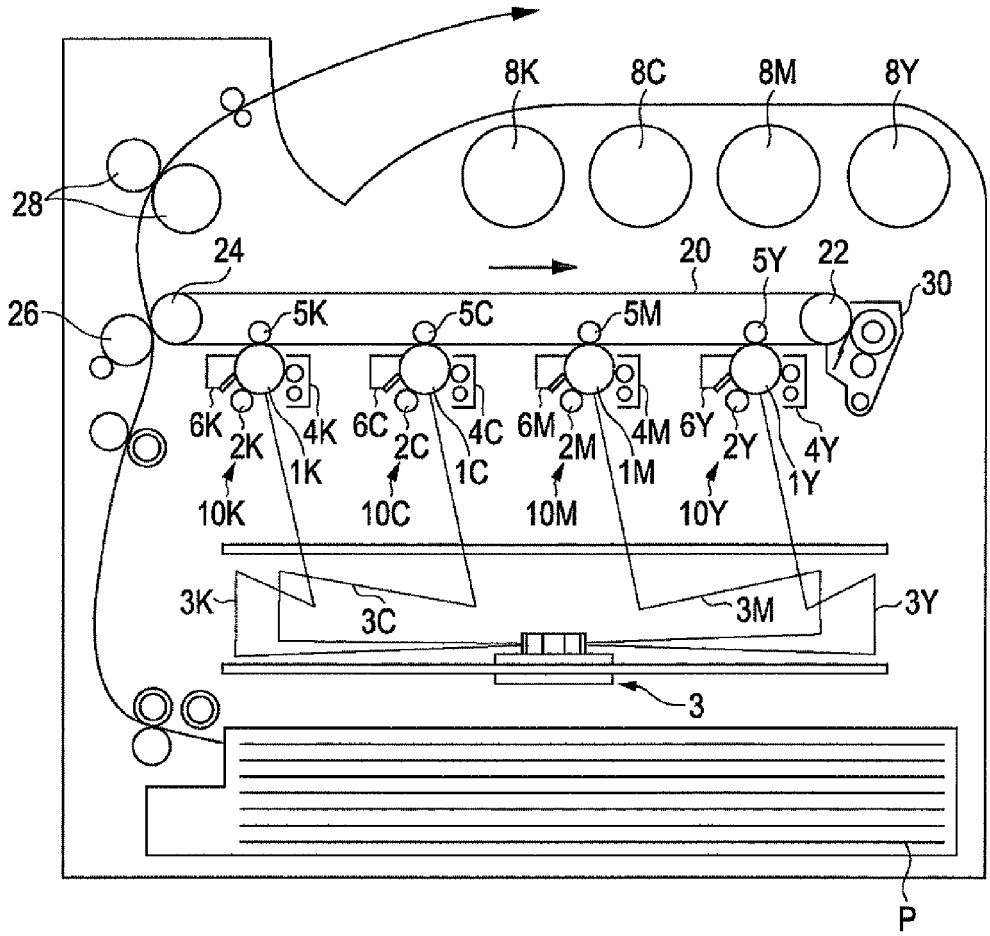
FIG. 2 schematically shows an image forming apparatus according to a second exemplary embodiment.

FIG. 2 schematically shows a four-color image forming apparatus, which is an image forming apparatus according to a second exemplary embodiment. The image forming apparatus shown in FIG. 2 includes a first electrophotographic image forming unit 10Y, a second electrophotographic image forming unit 10M, a third electrophotographic image forming unit 10C, and a fourth electrophotographic image forming unit 10K that respectively output a yellow (Y) image, a magenta (M) image, a cyan (C) image, and a black (K) image based on the image data subjected to color separation. These image forming units (hereinafter may be simply referred to as "units") 10Y, 10M, 10C, and 10K are arranged in a horizontal direction with a predetermined space therebetween. These units 10Y, 10M, 10C, and 10K may be process cartridges that are detachably installed in the main body of the image forming apparatus.

An intermediate transfer belt 20 serving as an intermediate transfer body is disposed in the upper part of each of the units 10Y, 10M, 10C, and 10K in the drawing so as to extend through each of the units. The intermediate transfer belt 20 is disposed so as to be wound around a driving roller 22 and a supporting roller 24 that is in contact with the inner surface of the intermediate transfer belt 20, the rollers being disposed so as to be away from each other in the left-right direction of the drawing. The intermediate transfer belt 20 moves in a direction from the first unit 10Y to the fourth unit 10K. A force is exerted on the supporting roller 24 with a spring or the like (not shown) in a direction away from the driving roller 22 so that a tensile force is provided to the intermediate transfer belt 20 wound around the rollers. An intermediate transfer body cleaning device 30 is disposed on the surface of an image supporting body of the intermediate transfer belt 20 so as to face the driving roller 22.

Furthermore, yellow, magenta, cyan, and black toners contained in toner cartridges 8Y, 8M, 8C, and 8K are respectively supplied to developing devices (developing units) 4Y, 4M, 4C, and 4K of the units 10Y, 10M, 10C, and 10K.

Since the above-described units 10Y, 10M, 10C, and 10K have the same structure, only the first unit 10Y that forms a yellow image and is disposed on the upstream side in the direction in which the intermediate transfer belt moves will be described herein. By replacing reference numeral Y (yellow) of the first unit 10Y or the like with reference numerals M (magenta), C (cyan), and K (black), the descriptions of the second to fourth units 10M, 10C, and 10K are omitted.

The first unit 10Y includes a photoconductor 1Y serving as an image supporting body. A charging roller 2Y, an exposure device (electrostatic charge image forming unit) 3, a developing device (developing unit) 4Y, a first transfer roller (first transferring unit) 5Y, and a photoconductor cleaning device (cleaning unit) 6Y are disposed near/on the circumference of the photoconductor 1Y in that order. The charging roller 2Y charges the surface of the photoconductor 1Y at a predetermined potential. The exposure device 3 exposes the charged surface to a laser beam 3Y based on the image signal subjected to color separation to form an electrostatic charge image. The developing device 4Y develops the electrostatic charge image by supplying charged toner to the electrostatic charge image. The first transfer roller 5Y transfers the developed toner image onto the intermediate transfer belt 20. The photoconductor cleaning device 6Y removes the toner left on the surface of the photoconductor 1Y after the first transfer.

The first transfer roller 5Y is disposed inside the intermediate transfer belt 20 so as to face the photoconductor 1Y. A bias power source (not shown) for applying a first transfer bias is connected to each of the first transfer rollers 5Y, 5M, 5C, and 5K. In the bias power source, a transfer bias applied to each of the first transfer rollers is controlled by a controller (not shown).

An operation of forming a yellow image at the first unit 10Y will now be described. First, the surface of the photoconductor 1Y is charged at a potential of about −600 to −800 V by the charging roller 2Y.

The photoconductor 1Y is obtained by stacking a photosensitive layer on a conductive base (volume resistivity: $1\times10^{-6}$ Ω·cm or less at 20° C.). The photosensitive layer normally has high resistance (substantially equal to the resistance of typical resins), but the irradiation with a laser beam 3Y changes the resistivity of portions irradiated with the laser beam 3Y. The laser beam 3Y is emitted onto the surface of the charged photoconductor 1Y from the exposure device 3 in accordance with the image data for yellow transmitted from a controller (not shown). The laser beam 3Y is applied to the photosensitive layer formed on the surface of the photoconductor 1Y, and thus an electrostatic charge image having a yellow printing pattern is formed on the surface of the photoconductor 1Y.

The electrostatic charge image is an image formed on the surface of the photoconductor 1Y by charging. The electrostatic charge image is a so-called negative latent image formed through the phenomenon in which, when the photosensitive layer is irradiated with the laser beam 3Y and the resistivity of the portion subjected to the irradiation is decreased, the charge on the surface of the photoconductor 1Y flows out whereas the charge in the portion not irradiated with the laser beam 3Y remains left.

In such a manner, the electrostatic charge image formed on the photoconductor 1Y is rotated to a predetermined development position through the rotation of the photoconductor 1Y. At the development position, the electrostatic charge image formed on the photoconductor 1Y is visualized (developed) by the developing device 4Y.

An electrostatic charge image developer containing, for example, at least yellow toner and a carrier is accommodated in the developing device 4Y. The yellow toner is held on a developer roller (developer supporting body) while having the same negative charge as that of the photoconductor 1Y, the charge being obtained as a result of triboelectrification caused by being stirred inside the developing device 4Y. When the surface of the photoconductor 1Y passes through the developing device 4Y, the yellow toner is attached to the charge-eliminated latent image portions on the surface of the photoconductor 1Y by electrostatic force, and thus a latent image is developed with the yellow toner.

In view of development efficiency, image graininess, and tone reproduction, a bias potential (development bias) obtained by superimposing an alternating component on a direct component may be applied to the developer supporting body. Specifically, when direct-current voltage Vdc applied to the developer supporting body is −300 to −700 V, the peak width of alternating voltage Vp-p applied to the developer supporting body may fall in the range of 0.5 to 2.0 kV.

The photoconductor 1Y on which the yellow toner image has been formed continuously rotates at a predetermined rate, and the toner image developed on the photoconductor 1Y is conveyed to a predetermined first transfer position.

When the yellow toner image formed on the photoconductor 1Y is conveyed to the first transfer position, a first transfer bias is applied to the first transfer roller 5Y and an electrostatic force acting from the photoconductor 1Y toward the first transfer roller 5Y is exerted on the toner image. As a result, the toner image on the photoconductor 1Y is transferred onto the intermediate transfer belt 20. The transfer bias applied herein has a polarity (+) that is opposite to the polarity (−) of the toner. For example, in the first unit 10Y, the transfer bias is controlled to about +10 μA by a controller (not shown).

The toner left on the photoconductor 1Y is removed and collected by the cleaning device 6Y.

The first transfer bias applied to each of the first transfer rollers 5M, 5C, and 5K after the second unit 10M is also controlled in the same manner as in the first unit.

Thus, the intermediate transfer belt 20 having the yellow toner image transferred thereon at the first unit 10Y is sequentially conveyed to the second to fourth units 10M, 10C, and 10K, and multiple color toner images are transferred on the intermediate transfer belt 20.

The intermediate transfer belt 20 on which four-color toner images have been transferred at the first to fourth units reaches a second transfer section constituted by the intermediate transfer belt 20, the supporting roller 24 that is in contact with the inner surface of the intermediate transfer belt 20, and a second transfer roller (second transfer unit) 26 disposed on the image supporting surface side of the intermediate transfer belt 20. Recording paper (recording medium) P is supplied to a gap between the second transfer roller 26 and the intermediate transfer belt 20 using a supply mechanism at a predetermined timing, and then a second transfer bias is applied to the supporting roller 24. The transfer bias applied herein has the same polarity (−) as that of the toner, and thus an electrostatic force acting from the intermediate transfer belt 20 toward the recording paper P is exerted on the toner image. As a result, the toner image on the intermediate transfer belt 20 is transferred onto the recording paper P. The second transfer bias is determined in accordance with the resistance value detected by a resistance detecting unit (not shown) configured to detect the resistance of the second transfer section, and is controlled on a voltage basis.

Subsequently, the recording paper P is conveyed to a press-contact portion (nip portion) of a pair of fixing rollers in a fixing device (roller-based fixing unit) 28. The superimposed color toner image is heated and melted and thus fixed on the recording paper P.

Examples of the recording medium onto which the toner image is transferred include plain paper and OHP sheets used in an electrophotographic copier, a printer, or the like.

The recording paper P on which a color image has been fixed is conveyed to an eject unit, and a series of color image forming operations are completed.

In the image forming apparatus described above, the toner image is transferred to the recording paper P through the intermediate transfer belt 20. However, the image forming apparatus is not limited to such a structure, and a toner image may be directly transferred onto recording paper from a photoconductor.

Figure 3:
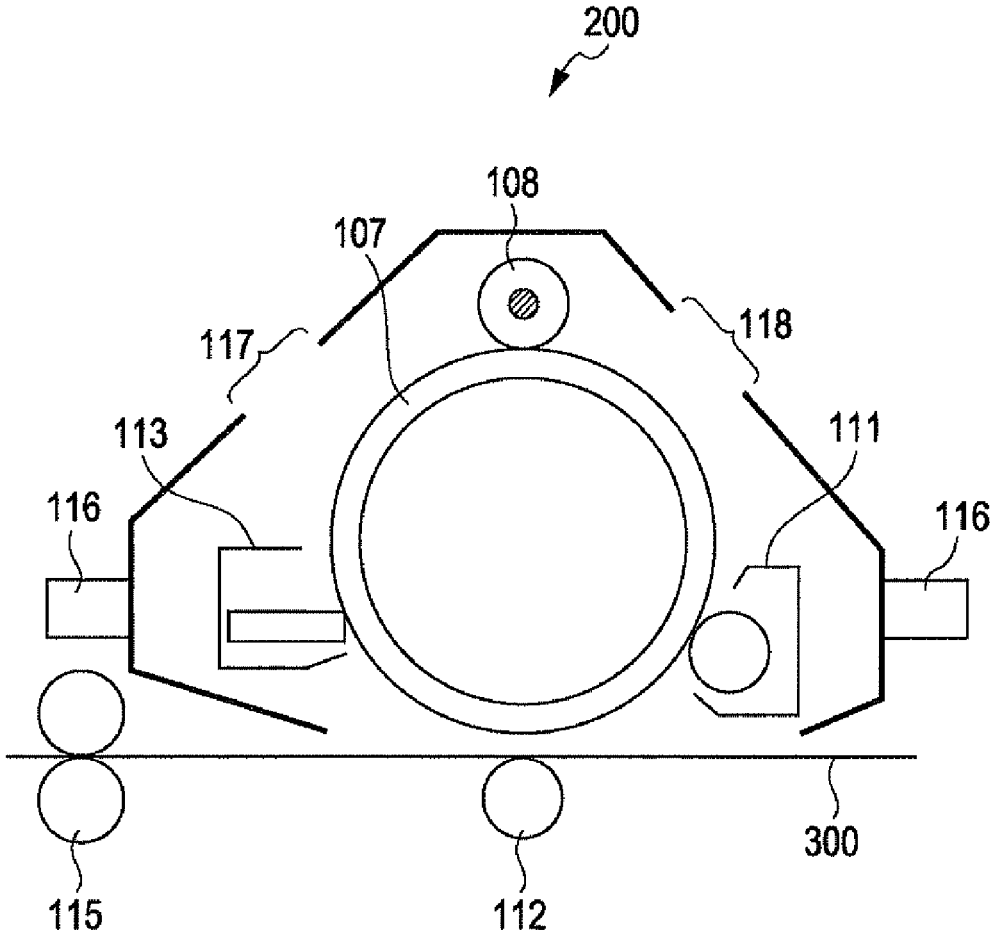
FIG. 3 schematically shows an example of a process cartridge according to this exemplary embodiment.

FIG. 3 schematically shows a suitable exemplary embodiment of a process cartridge that accommodates the electrostatic charge image developer according to this exemplary embodiment. A process cartridge 200 includes a developing device 111, a photoconductor 107, a charging roller 108, a photoconductor cleaning device 113, an opening 118 for exposure, and an opening 117 for static elimination, which are combined with each other using fitting rails 116 in an integrated manner. In FIG. 3, reference numeral 300 denotes a recording medium.

The process cartridge 200 is detachably installed in the main body of an image forming apparatus constituted by a transferring device 112, a fixing device 115, and other components (not shown). The process cartridge 200 and the main body constitutes an image forming apparatus.

The process cartridge 200 shown in FIG. 3 includes the photoconductor 107, the charging device 108, the developing device 111, the cleaning device 113, the opening 118 for exposure, and the opening 117 for static elimination, but these devices may be selectively combined with each other. In addition to the developing device 111, the process cartridge according to this exemplary embodiment may include at least one selected from the photoconductor 107, the charging device 108, the cleaning device (cleaning unit) 113, the opening 118 for exposure, and the opening 117 for static elimination.

Next, a toner cartridge will be described. A toner cartridge is detachably installed in an image forming apparatus and accommodates at least toner supplied to a developing unit disposed in the image forming apparatus. The toner cartridge needs only to accommodate at least toner. For example, a developer may be accommodated in the toner cartridge depending on the mechanism of the image forming apparatus.

The image forming apparatus shown in FIG. 2 is an image forming apparatus in which the toner cartridges 8Y, 8M, 8C, and 8K are detachably installed. The developing devices 4Y, 4M, 4C, and 4K are connected to toner cartridges that correspond to the respective developing devices through toner supply pipes (not shown). When the amount of toner accommodated in a toner cartridge is decreased, the toner cartridge is replaced.

EXAMPLES

The exemplary embodiment will now be specifically described in detail based on Examples and Comparative Examples, but is not limited to Examples. Note that "part" and "%" are expressed on a mass basis unless otherwise specified.

Preparation of Specific Titanium Dioxide Particles 1

An organic metal salt solution of titanium was mixed with an organic metal salt solution of niobium using Nanocreator FCM-MINI available from Hosokawa Micron Corporation so that the molar ratio of titanium content to niobium content was 95:5. The mixed solution was sprayed into a flame obtained by burning propane gas and oxygen gas in a mixed manner, and specific titanium dioxide particles 1 were collected using a filter. The molar ratio of titanium to niobium contained in the specific titanium dioxide particles 1 was 19:1.

The volume-average particle size of the resultant specific titanium dioxide particles 1 was measured with Submicron Particle Size Analyzer Delsa Nano S (available from Beckman Coulter, Inc.). The volume-average particle size was 21 nm.

The powder resistivity of the specific titanium dioxide particles 1 was obtained by measuring the volume resistivity with Powder Resistivity Measurement System Model MCP-PD51 (available from Mitsubishi Chemical Analytech Co., Ltd.) using a counter electrode probe at a voltage of 10 V at a pressure of 25 MPa. The powder resistivity was $4\times10^4$ Ω·cm.

Preparation of Specific Titanium Dioxide Particles 2

A target material of $Ti_{0.963}Nb_{0.037}O_2$ that had been subjected to reduction treatment was evaporated onto glass using a radio frequency (RF) magnetron sputtering apparatus in an oxygen/argon mixed gas atmosphere to obtain a film having a thickness of 20 nm. After the evaporation, the film was processed in a hydrogen atmosphere at 500° C. for two hours. The film was detached and collected from the glass to obtain specific titanium dioxide particles 2. The molar ratio of titanium to niobium was 26:1, the volume-average particle size was 32 nm, and the powder resistivity was $2\times10^3$ Ω·cm.

Preparation of Specific Titanium Dioxide Particles 3

Specific titanium dioxide particles 3 were prepared by the same method as that of the specific titanium dioxide particles 1, except that the molar ratio of titanium contained in the organic metal salt solution of titanium to niobium contained in the organic metal salt solution of niobium was made to be 250:1. The molar ratio of titanium to niobium was 250:1, the volume-average particle size was 22 nm, and the powder resistivity was $8\times10^6$ Ω·cm.

Preparation of Specific Titanium Dioxide Particles 4

Specific titanium dioxide particles 4 were prepared by the same method as that of the specific titanium dioxide particles 1, except that the molar ratio of titanium contained in the organic metal salt solution of titanium to niobium contained in the organic metal salt solution of niobium was made to be 199:1. The molar ratio of titanium to niobium was 199:1, the volume-average particle size was 24 nm, and the powder resistivity was $1\times10^5$ Ω·cm.

Preparation of Specific Titanium Dioxide Particles 5

Niobium pentachloride and anatase titanium dioxide particles were weighed so that the molar ratio of titanium contained in the anatase titanium dioxide particles to niobium contained in the niobium pentachloride was 5:1. The weighed niobium pentachloride was dissolved in analytical grade ethanol, and then the weighed anatase titanium dioxide particles were added thereto. The mixed solution was stirred for four hours and then dried in a vacuum dryer. The resultant dried powder was heated using an electric furnace in the air at 700° C. for eight hours, rapidly cooled using cold air, and crushed with a vibration mill. After this firing step was performed three times, the powder was further heated in a hydrogen gas atmosphere at 500° C. for three hours, rapidly cooled, and then crushed using a vibration mill to obtain specific titanium dioxide particles 5. The molar ratio of titanium to niobium was 5:1, the volume-average particle size was 150 nm, and the powder resistivity was $1\times10^3$ Ω·cm.

Preparation of Specific Titanium Dioxide Particles 6

Specific titanium dioxide particles 6 were prepared by the same method as that of the specific titanium dioxide particles 5, except that the amounts of niobium pentachloride and anatase titanium dioxide particles were changed so that the molar ratio of titanium contained in the anatase titanium dioxide particles to niobium contained in the niobium pentachloride was made to be 4:1. The molar ratio of titanium to niobium was 4:1, the volume-average particle size was 165 nm, and the powder resistivity was $1\times10^4$ Ω·cm.

Preparation of Specific Titanium Dioxide Particles 7

Specific titanium dioxide particles 7 were prepared by the same method as that of the specific titanium dioxide particles 5, except that the amounts of niobium pentachloride and anatase titanium dioxide particles were changed so that the molar ratio of titanium contained in the anatase titanium dioxide particles to niobium contained in the niobium pentachloride was made to be 19:1. The molar ratio of titanium to niobium was 19:1, the volume-average particle size was 185 nm, and the powder resistivity was $8\times10^2$ Ω·cm.

Preparation of Specific Titanium Dioxide Particles 8

Diniobium pentoxide and anatase titanium dioxide particles were weighed so that the molar ratio of titanium contained in the anatase titanium dioxide particles to niobium contained in the diniobium pentoxide was 19:1. The diniobium pentoxide and anatase titanium dioxide particles were dissolved in analytical grade ethanol, and the mixed solution was stirred for four hours and then dried in a vacuum dryer. The resultant dried powder was heated using an electric furnace in the air at 700° C. for eight hours, rapidly cooled using cold air, and crushed with a vibration mill. After this firing step was performed three times, the powder was further heated in a hydrogen gas atmosphere at 500° C. for three hours, rapidly cooled, and then crushed using a vibration mill to obtain specific titanium dioxide particles 8. The molar ratio of titanium to niobium was 19:1, the volume-average particle size was 920 nm, and the powder resistivity was $5\times10^3$ Ω·cm.

Preparation of Specific Titanium Dioxide Particles 9

Diniobium pentoxide and anatase titanium dioxide particles were weighed so that the molar ratio of titanium contained in the anatase titanium dioxide particles to niobium contained in the diniobium pentoxide was 19:1. The diniobium pentoxide and anatase titanium dioxide particles were dissolved in analytical grade ethanol, and the mixed solution was stirred for four hours and then dried in a vacuum dryer. The resultant dried powder was heated using an electric furnace in the air at 700° C. for eight hours, rapidly cooled using cold air, and crushed with a vibration mill. After this firing step was performed three times, the powder was further heated in a hydrogen gas atmosphere at 500° C. for three hours, rapidly cooled, and then crushed using a sample mixer to obtain specific titanium dioxide particles 9. The molar ratio of titanium to niobium was 19:1, the volume-average particle size was 1100 nm, and the powder resistivity was $2\times10^3$ Ω·cm.

Preparation of Coating Layer Formation Solution 1 toluene . . . 40 parts
styrene-methyl methacrylate copolymer (glass transition temperature: 70° C.) . . . 7 parts
specific titanium dioxide particles 1 . . . 2 parts
cross-linked melamine resin particles (Eposter S available from NIPPON SHOKUBAI Co., Ltd.) . . . 1 part The styrene-methyl methacrylate copolymer (coating resin), the specific titanium dioxide particles 1, and the cross-linked melamine resin particles were added to toluene, and stirred and dispersed with a sand mill to prepare a coating layer formation solution 1.

Preparation of Coating Layer Formation Solution 2 toluene . . . 40 parts
styrene-methyl methacrylate copolymer (glass transition temperature: 70° C.) . . . 7.5 parts
specific titanium dioxide particles 2 . . . 1.5 parts
cross-linked melamine resin particles (Eposter S available from NIPPON SHOKUBAI Co., Ltd.) . . . 1 part The styrene-methyl methacrylate copolymer (coating resin), the specific titanium dioxide particles 2, and the cross-linked melamine resin particles were added to toluene, and stirred and dispersed with a sand mill to prepare a coating layer formation solution 2.

Preparation of Coating Layer Formation Solution 3 toluene . . . 40 parts
styrene-methyl methacrylate copolymer (glass transition temperature: 70° C.) . . . 6.5 parts
specific titanium dioxide particles 3 . . . 2.5 parts
cross-linked melamine resin particles (Eposter S available from NIPPON SHOKUBAI Co., Ltd.) . . . 1 part The styrene-methyl methacrylate copolymer (coating resin), the specific titanium dioxide particles 3, and the cross-linked melamine resin particles were added to toluene, and stirred and dispersed with a sand mill to prepare a coating layer formation solution 3.

Preparation of Coating Layer Formation Solution 4 toluene . . . 40 parts
styrene-methyl methacrylate copolymer (glass transition temperature: 70° C.) . . . 7 parts
specific titanium dioxide particles 4 . . . 2 parts
cross-linked melamine resin particles (Eposter S available from NIPPON SHOKUBAI Co., Ltd.) . . . 1 part The styrene-methyl methacrylate copolymer (coating resin), the specific titanium dioxide particles 4, and the cross-linked melamine resin particles were added to toluene, and stirred and dispersed with a sand mill to prepare a coating layer formation solution 4.

Preparation of Coating Layer Formation Solution 5 toluene . . . 40 parts
styrene-methyl methacrylate copolymer (glass transition temperature: 70° C.) . . . 7 parts
specific titanium dioxide particles 5 . . . 2 parts
cross-linked melamine resin particles (Eposter S available from NIPPON SHOKUBAI Co., Ltd.) . . . 1 part The styrene-methyl methacrylate copolymer (coating resin), the specific titanium dioxide particles 5, and the cross-linked melamine resin particles were added to toluene, and stirred and dispersed with a sand mill to prepare a coating layer formation solution 5.

Preparation of Coating Layer Formation Solution 6 toluene . . . 40 parts
styrene-methyl methacrylate copolymer (glass transition temperature: 70° C.) . . . 7 parts
specific titanium dioxide particles 6 . . . 2 parts
cross-linked melamine resin particles (Eposter S available from NIPPON SHOKUBAI Co., Ltd.) . . . 1 part The styrene-methyl methacrylate copolymer (coating resin), the specific titanium dioxide particles 6, and the cross-linked melamine resin particles were added to toluene, and stirred and dispersed with a sand mill to prepare a coating layer formation solution 6.

Preparation of Coating Layer Formation Solution 7 toluene . . . 40 parts
styrene-methyl methacrylate copolymer (glass transition temperature: 70° C.) . . . 7.2 parts
specific titanium dioxide particles 7 . . . 1.8 parts
cross-linked melamine resin particles (Eposter S available from NIPPON SHOKUBAI Co., Ltd.) . . . 1 part The styrene-methyl methacrylate copolymer (coating resin), the specific titanium dioxide particles 7, and the cross-linked melamine resin particles were added to toluene, and stirred and dispersed with a sand mill to prepare a coating layer formation solution 7.

Preparation of Coating Layer Formation Solution 8 toluene . . . 40 parts
styrene-methyl methacrylate copolymer (glass transition temperature: 70° C.) . . . 7 parts
specific titanium dioxide particles 8 . . . 2 parts
cross-linked melamine resin particles (Eposter S available from NIPPON SHOKUBAI Co., Ltd.) . . . 1 part The styrene-methyl methacrylate copolymer (coating resin), the specific titanium dioxide particles 8, and the cross-linked melamine resin particles were added to toluene, and stirred and dispersed with a sand mill to prepare a coating layer formation solution 8.

Preparation of Coating Layer Formation Solution 9 toluene . . . 40 parts
styrene-methyl methacrylate copolymer (glass transition temperature: 70° C.) . . . 7 parts
specific titanium dioxide particles 9 . . . 7 parts
cross-linked melamine resin particles (poster S available from NIPPON SHOKUBAI Co., Ltd.) . . . 1 part The styrene-methyl methacrylate copolymer (coating resin), the specific titanium dioxide particles 9, and the cross-linked melamine resin particles were added to toluene, and stirred and dispersed with a sand mill to prepare a coating layer formation solution 9.

Preparation of Coating Layer Formation Solution 10

A coating layer formation solution 10 was prepared in the same manner as in the coating layer formation solution 1, except that the amount of toluene was changed to 34 parts and the amount of the specific titanium dioxide particles 1 was changed to 8 parts.

Preparation of Coating Layer Formation Solution 11

A coating layer formation solution 11 was prepared in the same manner as in the coating layer formation solution 1, except that the amount of toluene was changed to 35 parts and the amount of the specific titanium dioxide particles 1 was changed to 7 parts.

Preparation of Coating Layer Formation Solution 12

A coating layer formation solution 12 was prepared in the same manner as in the coating layer formation solution 1, except that the amount of toluene was changed to 39 parts and the amount of the specific titanium dioxide particles 1 was changed to 3 parts.

Preparation of Coating Layer Formation Solution 13

A coating layer formation solution 13 was prepared in the same manner as in the coating layer formation solution 1, except that the amount of toluene was changed to 39.5 parts and the amount of the specific titanium dioxide particles 1 was changed to 2.5 parts.

Preparation of Coating Layer Formation Solution 14

A coating layer formation solution 14 was prepared in the same manner as in the coating layer formation solution 1, except that the amount of toluene was changed to 41 parts and the amount of the specific titanium dioxide particles 1 was changed to 1 part.

Preparation of Coating Layer Formation Solution 15

A coating layer formation solution 15 was prepared in the same manner as in the coating layer formation solution 1, except that the amount of toluene was changed to 41.2 parts and the amount of the specific titanium dioxide particles 1 was changed to 0.8 parts.

Preparation of Coating Layer Formation Solution 16

A coating layer formation solution 16 was prepared in the same manner as in the coating layer formation solution 1, except that the amount of toluene was changed to 41.5 parts and the amount of the specific titanium dioxide particles 1 was changed to 0.5 parts.

Preparation of Coating Layer Formation Solution 17

A coating layer formation solution 17 was prepared in the same manner as in the coating layer formation solution 1, except that the amount of toluene was changed to 41.8 parts and the amount of the specific titanium dioxide particles 1 was changed to 0.2 parts.

Preparation of Coating Layer Formation Solution 18 toluene 40 parts
- styrene-methyl methacrylate copolymer (glass transition temperature: 70° C.) . . . 8 parts
- carbon black (VXC-72 available from Cabot Corporation, powder resistivity: $4\times10^{-2}$ Ω·cm) . . . 1 part
- cross-linked melamine resin particles (Eposter S available from NIPPON SHOKUBAI Co., Ltd.) . . . 1 part The styrene-methyl methacrylate copolymer (coating resin), the carbon black, and the cross-linked melamine resin particles were added to toluene, and stirred and dispersed with a sand mill to prepare a coating layer formation solution 18.

Preparation of Coating Layer Formation Solution 19 toluene . . . 40 parts
- styrene-methyl methacrylate copolymer (glass transition temperature: 70° C.) . . . 6 parts
- conductive particles (MT150AW titanium dioxide available from TAYCA CORPORATION, particle size: 15 nm, powder resistivity: $4\times10^{7}$ Ω·cm) . . . 3 parts
- cross-linked melamine resin particles (Eposter S available from NIPPON SHOKUBAI Co., Ltd.) . . . 1 part The styrene-methyl methacrylate copolymer (coating resin), the conductive particles, and the cross-linked melamine resin particles were added to toluene, and stirred and dispersed with a sand mill to prepare a coating layer formation solution 19.

Preparation of Coating Layer Formation Solution 20 toluene . . . 40 parts
- styrene-methyl methacrylate copolymer (glass transition temperature: 70° C.) . . . 6 parts
- titania particles doped with aluminum by plasma synthesis (ASTAC available from ISI. Ltd., average particle size: 20 nm, the amount of aluminum doping: 3%) . . . 3 parts
- cross-linked melamine resin particles (Eposter S available from NIPPON SHOKUBAI Co., Ltd.) . . . 1 part The styrene-methyl methacrylate copolymer (coating resin), the titania particles doped with aluminum, and the cross-linked melamine resin particles were added to toluene, and stirred and dispersed with a sand mill to prepare a coating layer formation solution 20.

Example 1

Preparation of Carrier

- ferrite particles (Mn—Mg ferrite, true specific gravity: 4.7 g/cm$^3$, volume-average particle size: 40 μm, saturation magnetization: 60 emu/g) . . . 100 parts
- coating layer formation solution 1 . . . 10 parts The ferrite particles (magnetic core particles) and the coating layer formation solution 1 were inserted into a pressure kneader and then heated to 60° C. After the mixture was stirred at 60° C. for 10 minutes, the pressure was reduced to distill off toluene. Furthermore, the mixture was heated to 70° C. and the pressure was reduced to distill off toluene. The carrier having a resin coating layer formed thereon was screened using a mesh with an opening of 75 μm to prepare a carrier 1.

The resistance of the carrier 1 (carrier resistance) was measured as a volume resistivity by a typical plate-type electrical resistance measurement method in which carrier particles are sandwiched between two plate electrodes and a current when a voltage is applied is measured. When 1000 V was applied, the carrier resistance was $5\times10^{9}$ Ω·cm.

Eight parts of external additive toner (volume-average particle size: 5.5 μm) produced by an emulsion aggregation method and 100 parts of the carrier 1 were stirred using a V blender at 40 rpm for 20 minutes, and then screened using a sieve with an opening of 125 μm to obtain a developer 1.

With the above-described developer, 100000 of 5%-printed charts were printed using a converted copier Docu Centre Color 500 (available from Fuji Xerox Co., Ltd.) at 28° C. and 85% RH. Color smear and white spots were evaluated when about 10 (initial stage), 10000, 50000, 80000, and 100000 charts were printed.

Color Smear

Poor: color smear is clearly seen through visual check.
Fair: color smear is slightly seen through visual check.
Good: color smear is not seen at all through visual check.

White Spots

Poor: there are five or more white spots.
Fair: there are two or more and four or less white spots.
Good: there is one or less white spot.

Table 1 shows the results. Note that the evaluations were stopped when a "poor" result was obtained.

Examples 2 to 17

Carriers 2 to 17 and developers 2 to 17 were prepared and evaluated in the same manner as in Example 1, except that the coating layer formation solution 1 of Example 1 was changed to the coating layer formation solutions 2 to 17, respectively. Table 1 shows the results.

Comparative Examples 1 to 3

Carriers 18 to 20 and developers 18 to 20 were prepared and evaluated in the same manner as in Example 1, except that the coating layer formation solution 1 of Example 1 was changed to the coating layer formation solutions 18 to 20, respectively. Table 1 shows the results.

TABLE 1

| | | | Image evaluation | | | | | | | | | |
|---|---|---|---|---|---|---|---|---|---|---|---|---|
| | | Carrier resistance | Color smear | | | | | White spot | | | | |
| | Developer | Ω · cm | Initial | 10000 | 50000 | 80000 | 100000 | Initial | 10000 | 50000 | 80000 | 100000 |
| Ex. 1 | 1 | $5 \times 10^{9}$ | Good | Good | Good | Good | Good | Good | Good | Good | Good | Good |
| Ex. 2 | 2 | $6 \times 10^{8}$ | Good | Good | Good | Good | Good | Good | Good | Good | Good | Good |
| Ex. 3 | 3 | $8 \times 10^{12}$ | Good | Good | Good | Good | Good | Good | Good | Fair | Fair | Fair |
| Ex. 4 | 4 | $4 \times 10^{10}$ | Good | Good | Good | Good | Good | Good | Good | Good | Fair | Fair |
| Ex. 5 | 5 | $9 \times 10^{8}$ | Good | Good | Good | Good | Fair | Good | Good | Good | Good | Good |
| Ex. 6 | 6 | $6 \times 10^{9}$ | Good | Good | Good | Fair | Fair | Good | Good | Good | Good | Fair |
| Ex. 7 | 7 | $8 \times 10^{8}$ | Good | Good | Good | Good | Good | Good | Good | Good | Good | Fair |
| Ex. 8 | 8 | $9 \times 10^{8}$ | Good | Good | Good | Good | Good | Good | Good | Good | Fair | Fair |
| Ex. 9 | 9 | $6 \times 10^{10}$ | Good | Good | Good | Good | Good | Good | Fair | Fair | Fair | Fair |
| Ex. 10 | 10 | $8 \times 10^{5}$ | Good | Good | Good | Good | Good | Good | Good | Good | Fair | Fair |
| Ex. 11 | 11 | $2 \times 10^{6}$ | Good | Good | Good | Good | Good | Good | Good | Good | Good | Fair |
| Ex. 12 | 12 | $9 \times 10^{7}$ | Good | Good | Good | Good | Good | Good | Good | Good | Good | Fair |
| Ex. 13 | 13 | $2 \times 10^{8}$ | Good | Good | Good | Good | Good | Good | Good | Good | Good | Good |
| Ex. 14 | 14 | $8 \times 10^{12}$ | Good | Good | Good | Good | Good | Good | Good | Good | Good | Good |
| Ex. 15 | 15 | $2 \times 10^{13}$ | Good | Good | Good | Good | Fair | Good | Good | Good | Good | Good |
| Ex. 16 | 16 | $9 \times 10^{13}$ | Good | Good | Good | Good | Fair | Good | Good | Good | Good | Good |
| Ex. 17 | 17 | $2 \times 10^{14}$ | Good | Good | Good | Fair | Fair | Good | Good | Good | Good | Good |
| C.E. 1 | 18 | $2 \times 10^{9}$ | Poor | Poor | — | — | — | Good | Good | — | — | — |
| C.E. 2 | 19 | $3 \times 10^{11}$ | Good | Good | Good | Good | — | Fair | Good | Fair | Poor | — |
| C.E. 3 | 20 | $4 \times 10^{11}$ | Good | Good | Good | Good | — | Fair | Good | Fair | Poor | — |

Ex.: Example
C.E.: Comparative Example

As is clear from the results of Examples, a developer that does not cause color smear and does not easily generate white spots even when used for a long time is obtained by using the specific titanium dioxide particles.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image development carrier comprising:

magnetic core particles; and a resin coating layer that contains titanium dioxide particles doped with niobium and coats each of the magnetic core particles.

2. The electrostatic charge image development carrier according to claim 1, wherein the molar ratio of niobium to titanium contained in the titanium dioxide particles doped with niobium is about 1:200 to 1:5.

3. The electrostatic charge image development carrier according to claim 1, wherein the volume-average particle size of the titanium dioxide particles doped with niobium is about 5 nm or more and 1000 nm or less.

4. The electrostatic charge image development carrier according to claim 1, wherein the electrical resistance of the titanium dioxide particles doped with niobium is about $10^{-5}$ Ω·cm or more and $10^{6}$ Ω·cm or less.

5. The electrostatic charge image development carrier according to claim 1, wherein the titanium dioxide particles doped with niobium contain about 70% or more anatase crystals.

6. The electrostatic charge image development carrier according to claim 1, wherein the volume resistivity value of the carrier is about $10^{6}$ Ω·cm or more and $10^{14}$ Ω·cm or less at 1000 V.

7. The electrostatic charge image development carrier according to claim 1, wherein the resin coating layer contains nitrogen-containing resin particles.

8. The electrostatic charge image development carrier according to claim 7, wherein the content of the nitrogen-containing resin particles is about 0.01 parts by mass or more and 5 parts by mass or less relative to 100 parts by mass of the magnetic core particles.

9. The electrostatic charge image development carrier according to claim 1, wherein the resin coating layer contains a wax.

10. The electrostatic charge image development carrier according to claim 9, wherein the melting temperature of the wax is about 80° C. or more and 150° C. or less.

11. The electrostatic charge image development carrier according to claim 1, wherein the volume-average particle size of the magnetic core particles is about 15 μm or more and 100 μm or less.

12. The electrostatic charge image development carrier according to claim 1, wherein the average thickness of the resin coating layer is about 0.1 μm or more and 10 μm or less.

13. An electrostatic charge image developer comprising:

the electrostatic charge image development carrier according to claim 1; and electrostatic charge image development toner.

14. A process cartridge comprising:

a developing unit that develops an electrostatic charge image formed on a surface of a latent image supporting body with the electrostatic charge image developer according to claim 13 to form a toner image, wherein the process cartridge is detachably installed in an image forming apparatus and accommodates the electrostatic charge image developer.

15. An image forming apparatus comprising:

a latent image supporting body;

a charging unit that charges a surface of the latent image supporting body;

an electrostatic charge image forming unit that forms an electrostatic charge image on the surface of the latent image supporting body;

a developing unit that develops the electrostatic charge image with the electrostatic charge image developer according to claim 13 to form a toner image;

a transferring unit that transfers the toner image onto a recording medium; and a fixing unit that fixes the toner image on the recording medium.

16. An image forming method comprising:

charging a surface of a latent image supporting body;

forming an electrostatic charge image on the surface of the latent image supporting body;

developing the electrostatic charge image with the electrostatic charge image developer according to claim 13 to form a toner image;

transferring the toner image onto a recording medium; and fixing the toner image on the recording medium.

17. An electrostatic charge image development carrier comprising:

magnetic core particles; and a resin coating layer that contains titanium dioxide particles doped with niobium and coats each of the magnetic core particles, wherein the resin coating layer contains nitrogen-containing resin particles, and wherein the content of the nitrogen-containing resin particles is about 0.01 parts by mass or more and 5 parts by mass or less relative to 100 parts by mass of the magnetic core particles.

* * * * *